US010865671B2

(12) United States Patent
Shieh et al.

(10) Patent No.: US 10,865,671 B2
(45) Date of Patent: Dec. 15, 2020

(54) OIL PAN ASSEMBLY

(71) Applicant: Toyota Motor Engineering & Manufacturing North America, Inc., Erlanger, KY (US)

(72) Inventors: Tenghua Tom Shieh, Ann Arbor, MI (US); Shohei Nomura, Ann Arbor, MI (US); Swetha Minupuri, Ann Arbor, MI (US); Dong-Hyun Lee, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 673 days.

(21) Appl. No.: 14/697,936

(22) Filed: Apr. 28, 2015

(65) Prior Publication Data

US 2016/0319715 A1 Nov. 3, 2016

(51) Int. Cl.
*F01M 11/00* (2006.01)

(52) U.S. Cl.
CPC ... *F01M 11/0004* (2013.01); *F01M 2011/005* (2013.01); *F01M 2011/007* (2013.01); *F01M 2011/0033* (2013.01)

(58) Field of Classification Search
CPC combination set(s) only.
See application file for complete search history.

(56) References Cited

U.S. PATENT DOCUMENTS 2,938,601 A 5/1960 Brafford
3,425,514 A 2/1969 Shier
4,770,276 A 9/1988 Takubo
4,848,293 A 7/1989 Sasada et al.
5,038,890 A 8/1991 Tanaka et al.
5,058,545 A 10/1991 Hirai et al.
5,103,782 A * 4/1992 Matsui ..... F01M 11/0004 123/195 C
5,158,053 A 10/1992 Krechberger et al.
5,852,991 A 12/1998 Yamamura et al.
6,041,751 A * 3/2000 Kuriyama ..... F01M 11/0004 123/195 C
6,340,012 B1 * 1/2002 Yamashita ..... F01M 11/0004 123/195 C
6,796,283 B1 9/2004 Fleury et al.
6,845,743 B1 1/2005 Bishop
8,069,834 B2 12/2011 Riedel et al.
8,578,906 B2 11/2013 Yamada et al.
2004/0177827 A1 * 9/2004 Hoyte ..... F01M 11/0004 123/196 AB (Continued)

OTHER PUBLICATIONS

R. Suzuki et al., "Removing Entrained Air in Hydraulic Fluids and Lubrication Oils", Machinery Lubrication, Jul. 2002.

(Continued)

*Primary Examiner* — Lindsay M Low
*Assistant Examiner* — Ruben Picon-Feliciano
(74) *Attorney, Agent, or Firm* — Dinsmore & Shohl LLP

(57) ABSTRACT

An oil pan assembly having an oil pan and an intake pipe attached to a bottom of an engine block is provided. The oil pan assembly includes an inner plate mounted to the oil pan so as to be disposed between the oil pan and a bottom surface of the engine block. The inner plate is configured to slow the flow of oil to an intake pipe so as to provide additional time for entrained oil to de-areate.

14 Claims, 6 Drawing Sheets

(56) References Cited

U.S. PATENT DOCUMENTS

2011/0073062 A1 3/2011 Nakashima et al.

OTHER PUBLICATIONS

Hielscher Ultrasonics GMBH, "Ultrasonic Homogenizers for Liquid Processing", http://www.hielscher.com/ultrasonic-homogenizers-for-liquid-processing-3.htm, 1999.

* cited by examiner

FIG. 5
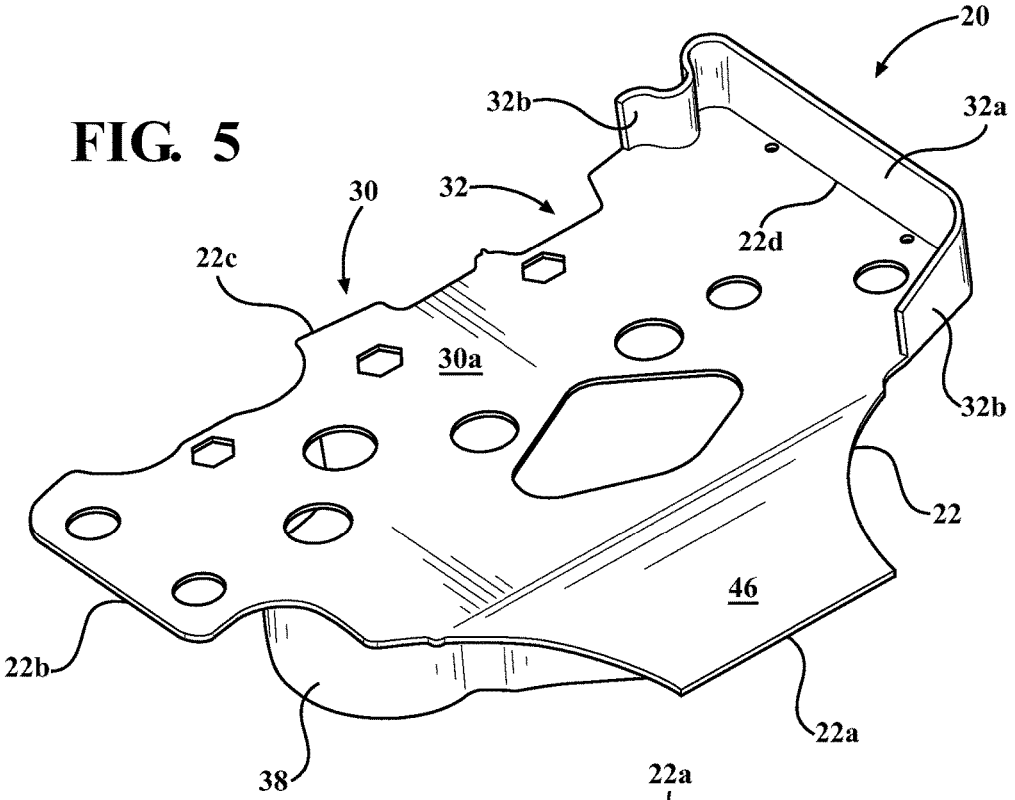
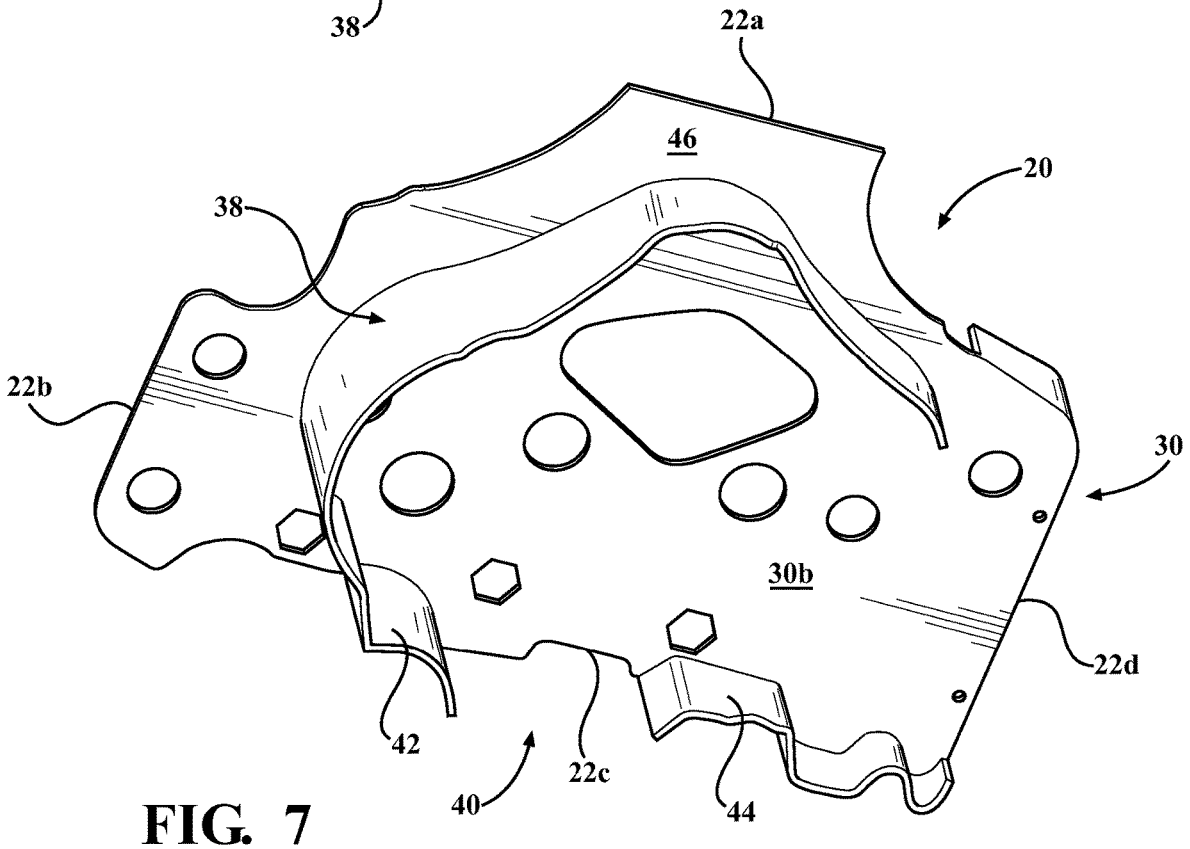
FIG. 7

OIL PAN ASSEMBLY

FIELD OF THE INVENTION

An oil pan assembly and an engine assembly configured to provide entrained oil time to de-areate prior to being pumped are provided.

BACKGROUND OF THE INVENTION

Oil pan assemblies are mounted to the bottom portion of an engine block and are used to capture oil distributed through the engine. An oil filter is attached to the oil pan assembly for removing particulates from the oil. The oil pan assembly may include an intake pipe. The intake pipe has an intake disposed adjacent the bottom of the oil pan.

A pump may also be attached to the intake pipe for recirculating the captured oil. The oil is directed throughout the engine. As oil is distributed throughout the engine, the oil is heated and subjected to force resulting from the operation of the engine. For instance, the operation of moving engine parts such as the chain, oil jet, and balancer areates the oil. Thus, the oil is frothy and entrained when received and collected by the oil pan. As such, the pump may not effectively redistribute the entrained oil. Accordingly, it remains desirable to have an oil pan assembly wherein the entrained oil is de-areated so as to achieve a liquid form optimal for distribution through the pump. For use herein, the term "de-aerated" refers to the process of removing air from the oil and the term "entrained" refers to a condition of the oil wherein air bubbles are introduced into the oil.

SUMMARY OF THE INVENTION

An oil pan assembly having an oil pan and an intake pipe attached to a bottom of an engine block is provided. The oil pan assembly includes an inner plate mounted to the oil pan so as to be disposed between the oil pan and a bottom surface of the engine block. The inner plate is configured to slow the flow of oil to an intake pipe so as to provide additional time for entrained oil to de-areate. Accordingly, oil drawn through the intake pipe is more viscous thus in better form for being pumped and recirculated back to the engine block.

The inner plate includes a first panel. The first panel has a top surface opposite a bottom surface. The first panel is disposed on a first plane. The inner plate includes a ramp contiguous with the first panel. The ramp is disposed on a second plane. The second plane is angled with respect to the first plane. The inner plate further includes a top wall disposed along a portion of a peripheral edge of the top surface of the first panel. The top wall slows the flow of entrained oil from the peripheral edge of the first panel so as to allow the entrained oil to de-areate before reaching the intake pipe fluidly connected to the pump.

An engine assembly is also provided. The engine assembly includes an engine block. The engine block may be tilted so as to direct oil towards an inner side surface of the engine block. An oil pan assembly is mounted to the bottom of the engine block. The oil pan assembly is configured to catch oil dripping off of the engine block.

The oil pan assembly includes an oil pan, an intake pipe, and a pump. The oil pan has a floor that is disposed along a generally horizontal plane. The oil pan is configured to catch entrained oil and direct the entrained oil to the pump via the intake pipe wherein the pump returns the oil to the engine block.

The engine assembly further includes an inner plate mounted to the oil pan. The inner plate is disposed between the oil pan and the engine block. The inner plate includes a first panel. The first panel has a top surface opposite a bottom surface. The first panel is disposed on a first plane. The first plane is angled with respect to the floor of the oil pan. The inner plate includes a ramp contiguous to the first panel. The ramp is disposed on a second plane angled with respect to the first plane so as to direct oil via gravity to the intake pipe. The inner plate includes a top wall disposed along a portion of the peripheral edge of the top surface of the first panel. The top wall slows the flow of entrained oil from the peripheral edge of the first panel so as to allow the entrained oil to de-areate before reaching the intake pipe.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

FIG. 5 is an isolated view of the inner plate shown in FIG. 4;

FIG. 7 is an isolated view of the inner plate shown in FIG. 6.

DETAILED DESCRIPTION OF THE PREFERRED EMBODIMENTS

An oil pan assembly and an engine assembly configured to slow entrained oil so as to provide the entrained oil time to de-areate before reaching the intake pipe are provided. The oil pan assembly is attached to the engine assembly. Specifically, the oil pan assembly is attached to the bottom of an engine block. The oil pan assembly includes an oil pan. The engine assembly further includes an intake pipe and a pump. The intake pipe is mounted to the bottom of the oil pan.

The oil pan assembly includes an inner plate mounted to the oil pan and disposed between the oil pan and the engine block. The inner plate includes a first panel which is angled so as to have one side edge elevated above an opposite side edge. The first panel includes a top surface opposite a bottom surface. The first panel is disposed on a first plane, the first plane being slanted. The inner plate includes a ramp. The ramp is contiguous to the first panel and disposed on a second plane. The second plane is angled with respect to the first plane.

The inner plate further includes a top wall disposed along a portion of a peripheral edge of the top surface of the first panel. Specifically, the top wall is disposed along the lower portion of the peripheral edge of the first panel so as to collect oil draining from the upper side edge. The top wall forms a catch preventing and slowing the flow of entrained oil to the intake pipe. The entrained oil is pooled along the top wall and then spills over the exposed peripheral edge of the first panel. Accordingly, the first wall allows the entrained oil additional time to de-areate before reaching the intake pipe.

Figure 1:
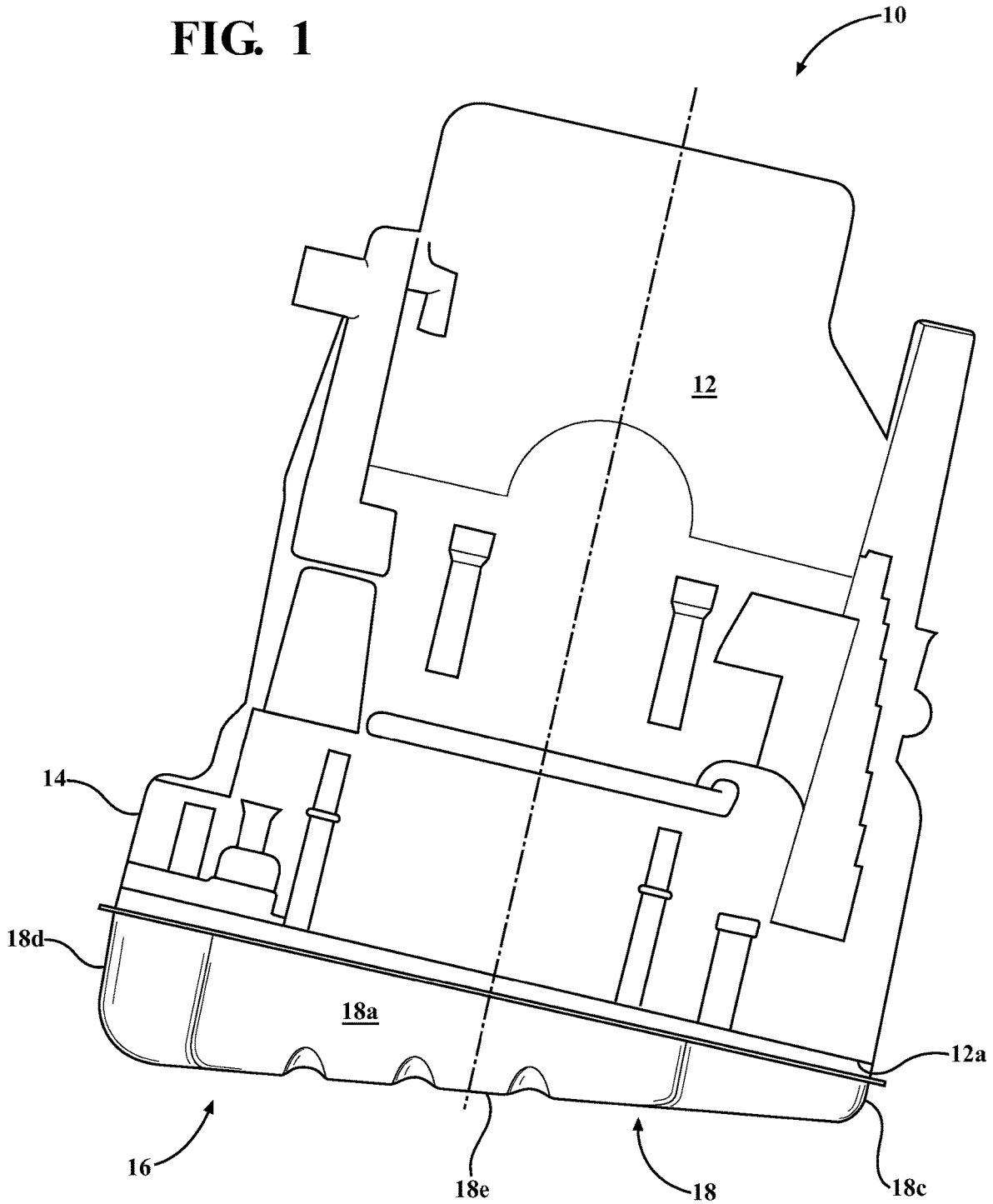
FIG. 1 is a perspective view taken from a front end of an engine block.

FIG. 1 shows a front end view of the engine assembly 10 showing the engine block 12. As shown, the body of the engine block 12 may be angled with respect to a generally horizontal bottom. The engine block 12 includes a casing 14. The casing 14 may be integrally formed to the bottom of the engine block 12. The casing 14 is a wall defining a chamber for which components may be housed. The casing 14 includes apertures 14*a* for which the oil pan assembly 16 may be mounted to.

The oil pan 18 further includes a front wall 18*a* opposite a back wall 18*b* and a lip 18*c*. The lip 18*c* is opposite a first side wall 18*d* and is shorter relative to the first side wall 18*d*. The oil pan assembly 16 includes an oil pan 18 that is mounted to a bottom surface 12*a* of the engine block 12.

Figure 2:
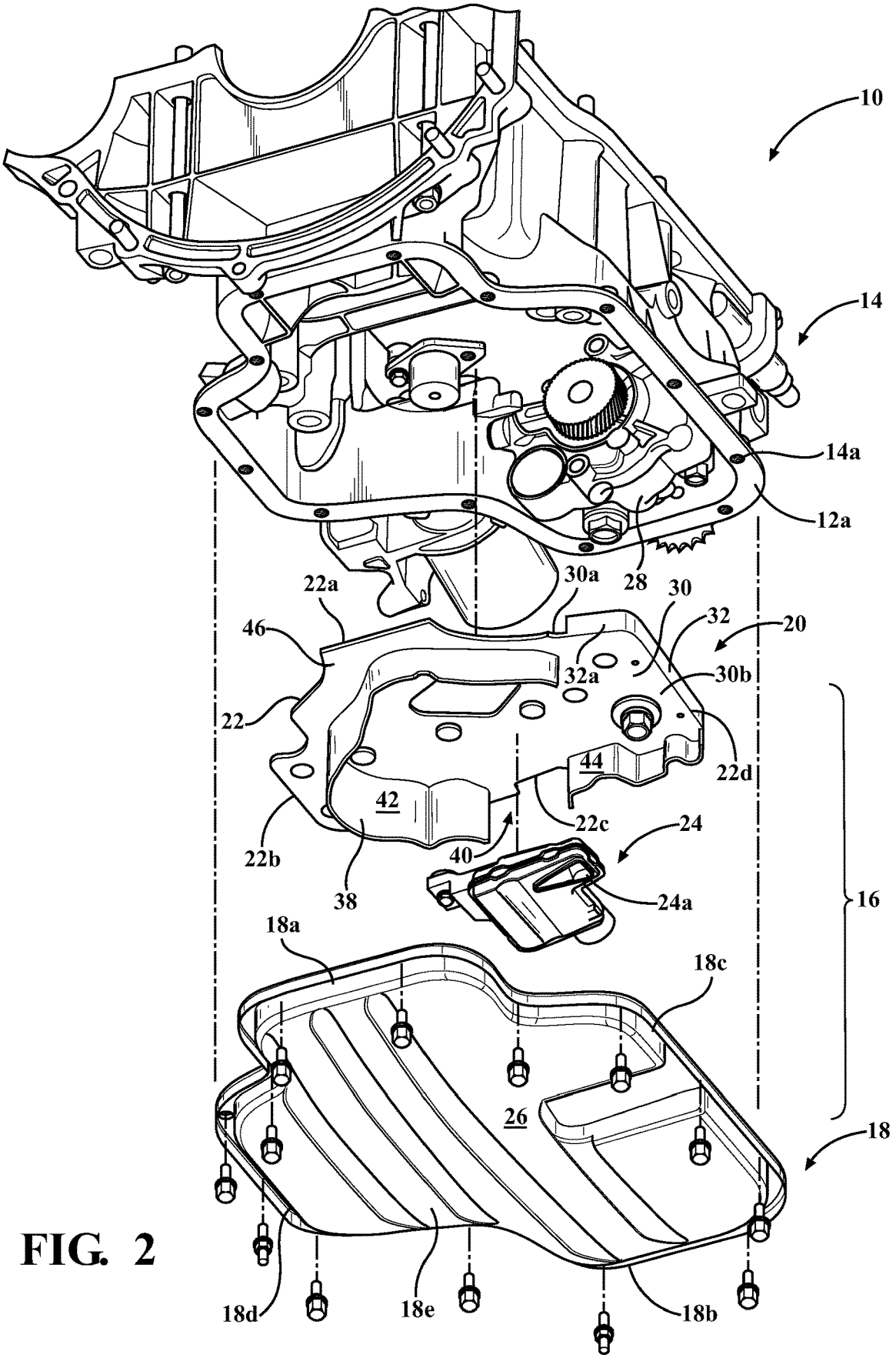
FIG. 2 is an exploded view of FIG. 1 showing the oil pan assembly, and the engine block assembly.

With now to FIG. 2, an exploded view of the engine block 12 is provided. The oil pan 18 is mounted to a bottom surface 12*a* of the engine block 12. The oil pan assembly 16 includes an inner plate 20. The inner plate 20 is disposed within the casing 14 and between the oil pan 18 and the engine block 12. The inner plate 20 is mounted to the oil pan 18. The inner plate 20 has a peripheral edge 22. The peripheral edge 22 includes a front edge portion 22*a*, an elevated side portion 22*b*, a back edge portion 22*c* and a lower side portion 22*d*.

An intake pipe 24 is disposed within the casing 14 and between the inner plate 20 and the floor 26 of the oil pan 18. The intake pipe 24 includes an opening 24*a* for which entrained oil is drawn into. A pump 28 is mounted to an outlet of the intake pipe 24. The pump 28 is configured to generate a vacuum pressure to draw collected oil and recycle the oil through the engine block 12.

The inner plate 20 has a first panel 30. The first panel 30 includes a plurality of through holes to accommodate structure such as balance shaft cover bolts. The first panel 30 includes a top surface 30*a* opposite a bottom surface 30*b*. The top surface 30*a* is opposite the bottom surface 12*a* of the engine block 12 and the bottom surface 30*b* of the first panel 30 is opposite the floor 26 of the oil pan 18.

With reference again to FIG. 3, the inner plate 20 is slanted so as to direct oil from an elevated side portion 22*b* to the lower side portion 22*d*. The first panel 30 is disposed on a first plane. The first plane is angled with respect to the floor 26 and the bottom surface 30*b* of the first panel 30 is generally parallel to the bottom of the engine block 12. The first panel 30 includes a ramp 46 that is contiguous with the first panel 30. The ramp 46 is disposed on a second plane that is angled with respect to the first plane. The ramp 46 is configured to direct captured oil towards a front wall 24 of the oil pan 18.

Figure 3:
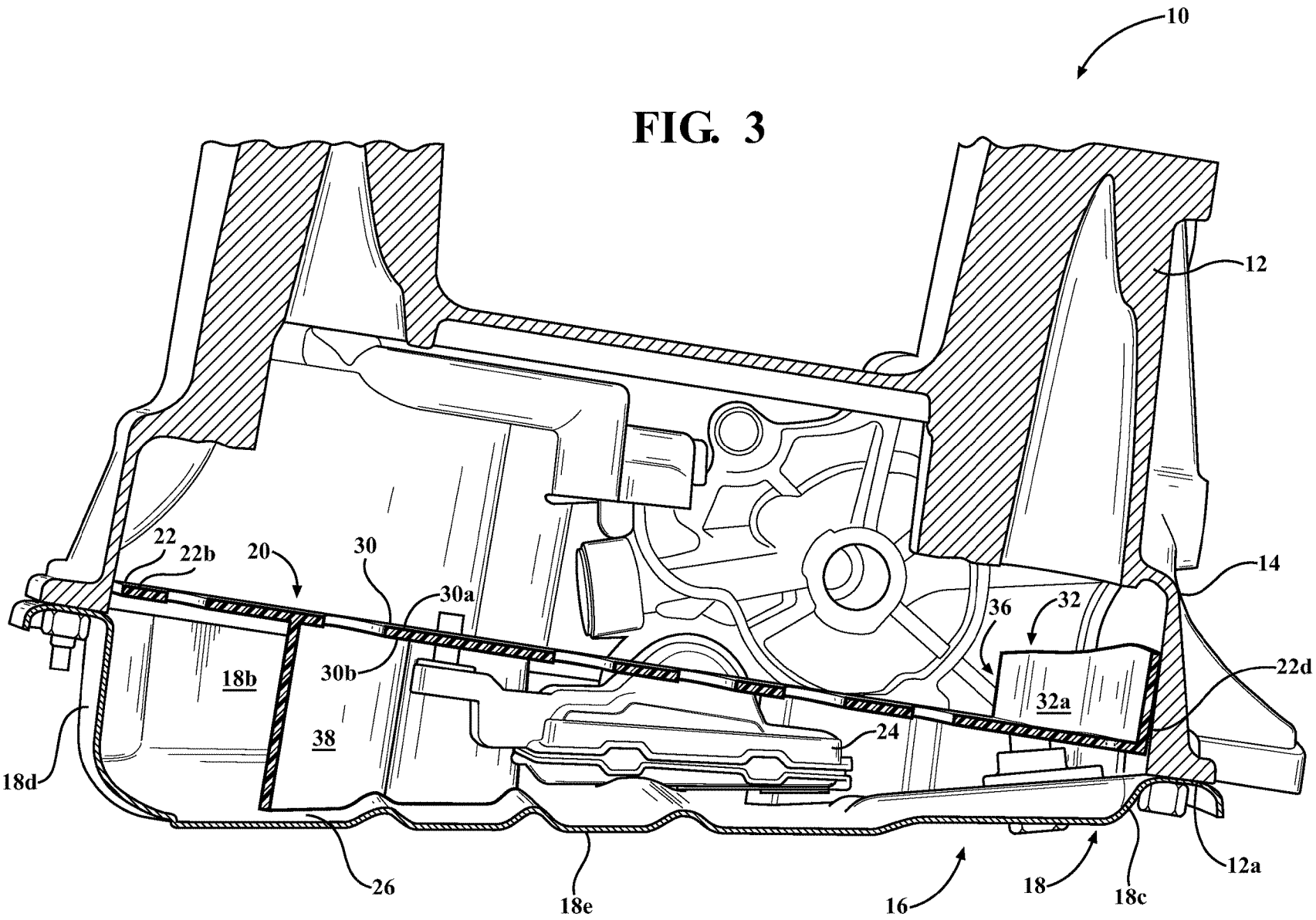
FIG. 3 is cross-section view of FIG. 1 taken along lines 3-3.

With reference again to FIG. 3, a cross-sectional view of the engine assembly 10 is provided. FIG. 3 shows the inner plate 20 disposed between the oil pan 18 and the bottom of the engine block 12. The engine block 12 is tilted and the bottom surface 18*e* of the oil pan 18 is disposed on a generally horizontal plane. The first panel 30 is shown angled with respect to the bottom surface 18*e* of the oil pan 18. The top wall 32 is shown disposed on the lower peripheral edge of the first panel 30 so as to collect entrained oil. The entrained oil is pooled against the top wall 32 and eventually spills over the inner plate 20 and flows to the intake pipe 34. Thus, FIG. 3 shows how the oil pan assembly 16 provides more time for entrained oil to de-areate relative to current oil pan assemblies.

Figure 4:
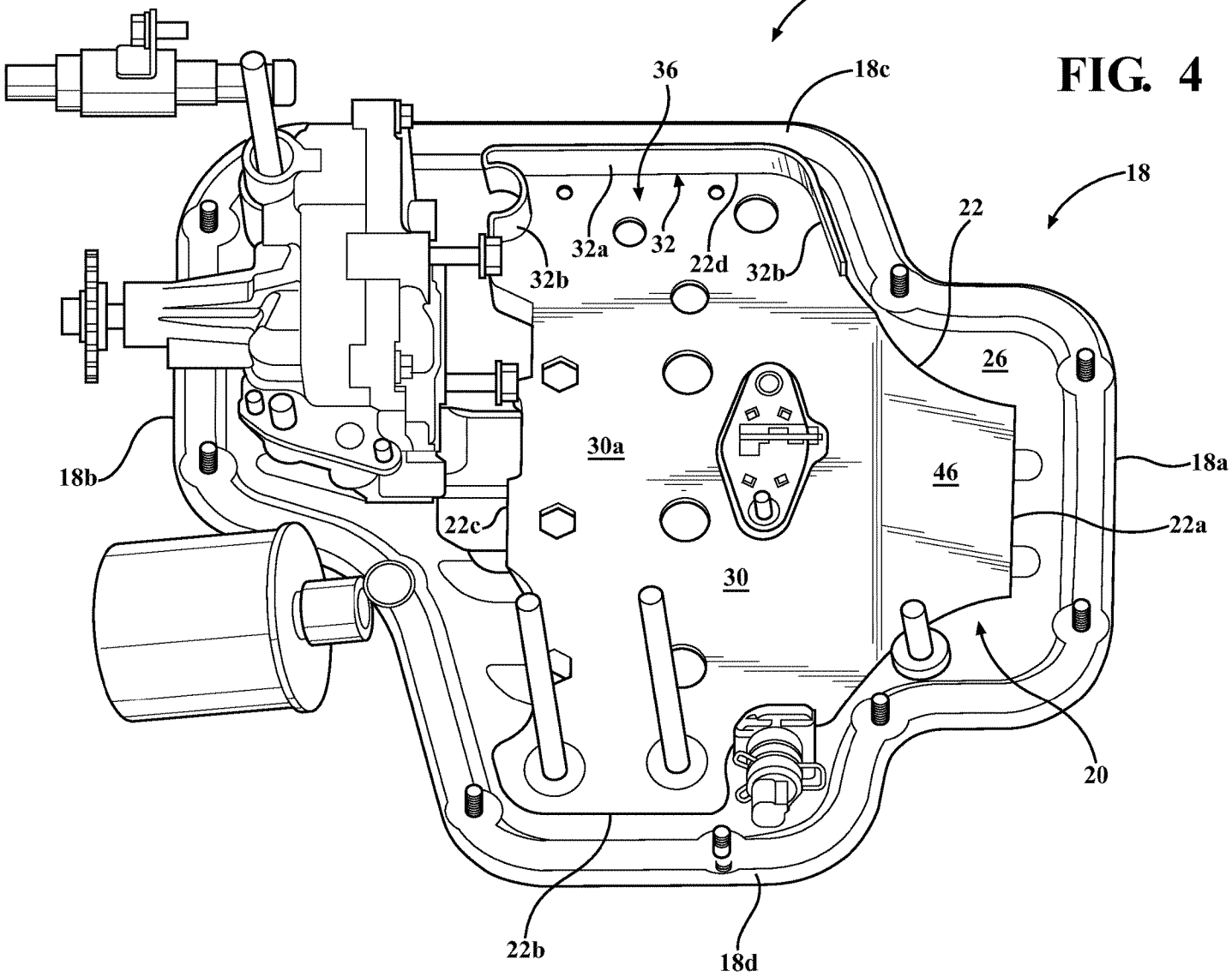
FIG. 4 is a view of the oil pan assembly taken from above.

With now to FIGS. 4 and 5, an illustrative view of the top of the inner plate 20 is provided. The first panel 30 includes a plurality of through-holes 30*c* for which attachment features and mechanical components may be seated. FIGS. 3, 4 and 5 also show the top wall 32. The top wall 32 is disposed along the lower side portion 22*d* of the top surface 30*a* of the first panel 30, and a portion of both the back edge portion 22*c* and front edge portion 22*a* of the top surface 30*a* of the first panel 30. The top wall 32 is generally orthogonal to the first panel 30. FIG. 3, shows the top edge of the top wall 32 being generally level with the elevated side portion 32*b* of the first panel 30.

Figure 6:
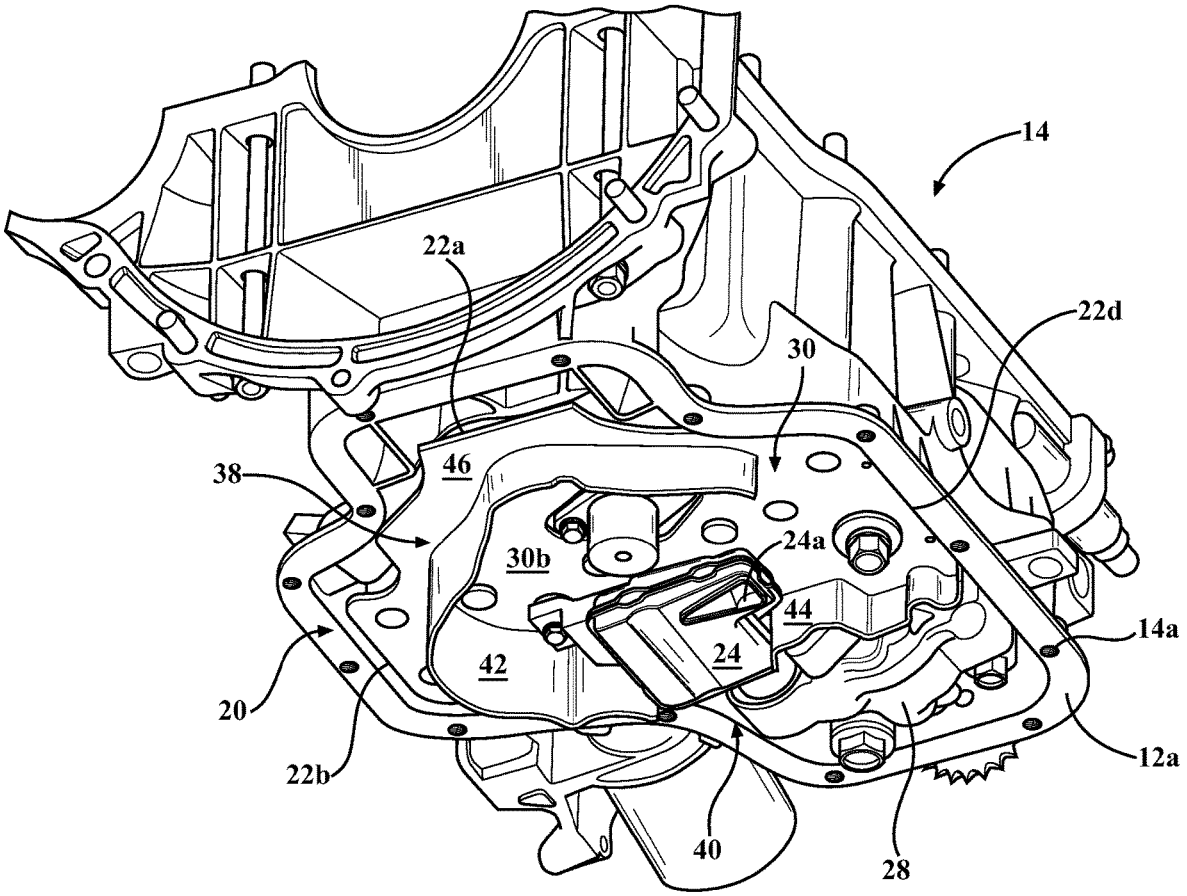
FIG. 6 is a view of the oil pan assembly taken from the bottom.

The top wall 32 includes a main top wall portion 32*a* and a pair of secondary top wall portions 32*b* forming a generally U-shaped profile which is easily seen in FIGS. 4 and 6. The top wall 32 is contiguous to a portion of the peripheral edge 32 of the first panel 30. Specifically, the main top wall portion 32*a* runs along the lower side portion 32*d* and the secondary top wall portions 32*b* extend generally orthogonal from the ends of the main top wall portion 32*a* and runs along a respective front edge portion 32*c* and back edge portion 32*d*.

FIG. 3 shows, the main top wall portion 32*a* disposed on the lower side portion 32*d* of the peripheral edge 32 of the first panel 30. Thus, it should be appreciated that as oil drips onto the first panel 30 the entrained oil via gravity slides along the first panel 30 towards the top wall 32. The top wall 32 forms a catch 36 in which captured entrained oil may settle before seeping over the peripheral edge 32 onto the oil pan 18 and into the intake pipe 24. As entrained oil is collected in the catch 36 defined between a portion of the first panel 30 and the top wall 32, the entrained oil is provided time to de-areate thus forming a liquid which is optimal for distribution through the pump 28.

With reference again to FIG. 3 and now to FIGS. 5 and 7 an illustration of the bottom of the inner plate 20 is provided. The oil pan assembly 16 may further include a bottom wall 38. The bottom wall 38 is spaced apart from the peripheral edge 22 of the first panel 30. The bottom wall 38 is disposed on the bottom surface 30*b* of the first panel 30 and extends downwardly towards the floor 26 of the oil pan 18. The bottom wall 38 partially encloses the intake pipe 24. The bottom wall 38 includes a plurality of curvatures configured to slow the flow of oil to the intake pipe 24 so as to allow the oil additional time to de-areate prior to being distributed through the pump 28.

As shown in FIGS. 3 and 5, the top wall 32 and the bottom wall 38 are generally mounted opposite each other. FIG. 5 also shows that a portion of the bottom wall 38 extends along the elevated side portion 22*b* of the inner plate 20. Another portion of the bottom wall 38 runs along the outer periphery of the intake pipe 24 and includes a bottom wall opening 40 for which entrained oil may flow freely towards the intake pipe 24.

The bottom wall 38 is generally orthogonal to the bottom surface 30*b* of the first panel 30. The bottom wall 38 may vary in height so as to abut against the floor 26 of the oil pan 18. As the first panel 30 is slanted, the portion of the bottom wall 38 adjacent the first side wall 18*d* of the oil pan 18 is taller relative to the portion of the bottom wall 38 adjacent the lip 18*c* of the oil pan 18. Some of the oil dripping off the engine block 12 will run along the first side wall 18*d* of the oil pan 18. The bottom wall 38 directs such oil from flowing freely into the intake pipe 24, thus providing the entrained oil with additional time to de-areate.

The bottom wall 38 may include a first portion 42 spaced apart from a second portion 44. The first portion 42 is generally C-shaped. The second portion 44 includes a plurality of curves and is generally contiguous to a back edge portion 22*c* of the first panel 30. One end of the first portion 42 is adjacent a side edge of the intake pipe 24. The other end of the second portion 44 is adjacent the other side edge of the intake pipe 24. The opposite ends of the respective first and second portions 42, 44 of the bottom wall 38 are spaced apart from each other so as to form the opening 40 for which oil may flow unimpeded to the intake pipe 24.

In operation, the oil pan assembly 16 is configured to disrupt the flow of oil to the intake pipe 24. The first panel 30 is slanted so as to direct oil into the catch 36 formed by the top wall 32, wherein the oil pools and eventually spills over an unobstructed peripheral edge 22 of the first panel 30. As entrained oil spills over the peripheral edge 22 of the first panel 30, the entrained oil through gravity assist contacts the bottom wall 38 wherein the oil drains along the path defined by the bottom wall 38 towards the intake pipe 24. Accordingly, the oil pan assembly 16 provides a path that increases the time required for entrained oil to reach the intake pipe 24, wherein the additional time allows for the entrained oil to de-areate, making the oil more viscous, so as to improve the performance of the pump 28.

With reference again to FIGS. 1, 2 and 3, an engine assembly 10 is provided. FIG. 1 is a front end view of the engine assembly 10 showing the engine block 12. As shown, the body of the engine block 12 may be angled. The engine block 12 includes a casing 14. The casing 14 may be integrally formed to the bottom of the engine block 12. The casing 14 is a wall defining a chamber for which components may be housed. The casing 14 includes apertures 14*a* for which the oil pan assembly 16 may be mounted to.

The oil pan assembly 16 mounted to the bottom of the engine block 12. The oil pan assembly 16 is configured to collect oil dripping from the engine block 12 and chain case (not shown). The oil pan assembly 16 includes an oil pan 18. The oil pan 18 is attached to the casing 14. The oil pan 18 includes a first side wall 20 and a floor 26. The first side wall 20 is generally disposed on a vertical plane. The floor 26 is generally disposed along a horizontal plane. The oil pan 18 further includes a front wall 18*a* opposite a back wall 18*b* and a lip 18*c*. The lip 18*c* is opposite a first side wall 18*d* and is shorter relative to the first side wall 18*b*. The peripheral edge 22 of the oil pan 18 include a plurality of through holes to allow for a fastening device such as a bolt to secure the oil pan 18 to the bottom of the engine block 12.

With reference again to FIG. 2, an exploded view of the engine assembly 10 showing the engine block 12, the engine casing 14 and the oil pan assembly 16 is provided. The oil pan assembly 16 includes an inner plate 20. The inner plate 20 is disposed within the casing 14 and between the oil pan 18 and the engine block 12. The inner plate 20 is mounted to the oil pan 18. The inner plate 20 has a peripheral edge 32. The peripheral edge 32 includes a front edge portion 22*a*, an elevated side portion 22*b*, a back edge portion 22*c* and a lower side portion 22*d*.

An intake pipe 24 is disposed within the casing 14 and between the inner plate 20 and the floor 26 of the oil pan 18. The intake pipe 24 includes an opening 24*a* for which oil is drawn into. A pump 28 is mounted to an outlet of the intake pipe 24. The pump 28 is configured to generate a vacuum pressure to draw collected oil and recycle the oil through the engine block 12.

The inner plate 20 has a first panel 30. The first panel 30 includes a plurality of through holes for which bolts and attachment features may pass through so as to attach the oil pan to the engine block 12. The first panel 30 includes a top surface 30*a* opposite a bottom surface 30*b*. The top surface 30*a* is opposite the bottom surface 30*b* of the engine block 12 and the bottom surface 30*b* of the first panel 30 is opposite the floor 26 of the oil pan 18.

With reference now to FIG. 3, the inner plate 20 is slanted so as to direct oil from elevated side portion 22*b* to the lower side portion 22*d*. The first panel 30 is disposed on a first plane. The first plane is angled with respect to the floor 26 and generally parallel to a bottom surface 30*b* of the engine block 12. The first panel 30 includes a ramp 46 that is contiguous with the first panel 30. The ramp 46 is disposed on a second plane that is angled with respect to the first plane. The ramp 46 is configured to direct captured oil towards a front wall 18*a* of the oil pan 18.

With reference again to FIG. 3, and now to FIGS. 4 and 6, an illustrative view of the inner plate 20 is provided. The first panel 30 includes a plurality of through-holes for which attachment features and mechanical components may be seated. FIGS. 3, 4 and 6 also show a top wall 32. The top wall 32 is disposed along the lower side portion 22*d* of the top surface 30*a* of the first panel 30, a portion of both the back edge portion 22*c* and a portion of the front edge portion 22*a* of the top surface 30*a* of the first panel 30. The top wall 32 is generally orthogonal to the first panel 30. FIG. 3, shows the top edge of the top wall 32 being generally level with the elevated side portion 22*b* of the first panel 30.

The top wall 32 includes a main top wall portion 32*a* and a pair of secondary top wall portions 32*b* forming a generally U-shaped profile which is easily seen in FIGS. 4 and 6. The top wall 32 is contiguous to a portion of the peripheral edge 22 of the first panel 30. The main top wall portion 32*a* runs along the lower side portion 22*d* and the secondary top wall portions 32*b* extend generally orthogonal from the ends of the main top wall portion 32*a* and runs along respective front edge portions 22*a* and back edge portions 22*c* of the peripheral edge 22 of the first panel 30. FIG. 3 shows, the main top wall portion 32*a* disposed on the lower side portion 22*d* of the peripheral edge 22 of the first panel 30. Thus, it should be appreciated that as oil drips onto the first panel 30 the oil via gravity slides along the first panel 30 towards the top wall 32. The top wall 32 forms a catch 36 in which captured oil may settle before seeping over the peripheral edge 32 onto the oil pan 18 and into the intake pipe 24. As oil is collected in the catch 36 defined between a portion of the first panel 30 and the top wall 32, the entrained oil is provided time to de-areate thus forming a liquid which is optimal for distribution through the pump 28.

With reference again to FIG. 3 and now to FIGS. 5 and 7 an illustration of the bottom of the inner plate 20 is provided. The oil pan assembly 16 may further include a bottom wall 38. The bottom wall 38 is spaced apart from the peripheral edge of the first panel 30. The bottom wall 38 is disposed on the bottom surface 30*b* of the first panel 30 and extends downwardly towards the floor 26 of the oil pan 18. The bottom wall 38 partially encloses the intake pipe 24. The bottom wall 38 includes a plurality of curvatures configured to slow the flow of oil to the intake pipe 24 so as to allow the oil additional time to de-areate prior to being distributed through the pump 28.

As shown in FIGS. 3 and 5, the top wall 32 and the bottom wall 38 are generally mounted opposite each other. FIG. 5 also shows that the bottom wall 38 runs along the outer periphery of the intake pipe 24 and provides bottom wall opening 40 for which oil may flow freely towards the intake pipe 24. The bottom wall 38 is generally orthogonal to the bottom surface 30*b* of the first panel 30. The bottom wall 38 may vary in height so as to abut against the floor 26 of the oil pan 18. As the first panel 30 is slanted, the portion of the bottom wall 38 adjacent the first side wall 20 of the oil pan 18 is higher in elevation relative to the portion of the bottom wall 38 adjacent the lip 28 of the oil pan 18. Some of the oil dripping off the engine block 12 will run along the first side wall 20 of the oil pan 18. The bottom wall 38 directs such oil from flowing freely into the intake pipe 24, thus providing the entrained oil with additional time to de-areate.

The bottom wall 38 may include a first portion 42 spaced apart from a second portion 44. The first portion 42 is generally C-shaped. The second portion 44 includes a plurality of curves and is generally contiguous to a back peripheral edge of the first panel 30. One end of the first portion 42 is adjacent a side edge of the intake pipe 24. One end of the second portion 44 is adjacent the other side edge of the intake pipe 24. The opposite ends of the respective first and second portions 42, 44 of the bottom wall 38 are spaced apart from each other so as to form the bottom wall opening 40 for which oil may flow unimpeded to the intake pipe 24.

In operation, the oil pan assembly 16 is configured to disrupt the flow of oil of the tilted engine block 12 to the intake pipe 24. The first panel 30 is slanted so as to direct oil into the catch formed by the top wall 32, wherein the oil pools and eventually spills over an unobstructed peripheral edge of the first panel 30. As entrained oil spills over the peripheral edge of the first panel 30, the entrained oil through gravity assist contacts the bottom wall 38 wherein the oil drains along the path defined by the bottom wall 38 towards the intake pipe 24. Accordingly, the oil pan assembly 16 provides a path that increase the time required for entrained oil to reach the intake pipe 24, wherein the additional time allows for the entrained oil to de-aerate so as to improve the performance of the pump 28.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

The invention claimed is:

1. An oil pan assembly having an oil pan and an intake pipe attached to a bottom of an engine block, the oil pan having a floor, the oil pan assembly comprising:

an inner plate mounted to the oil pan and disposed between the oil pan and the engine block, the inner plate having a first panel, the first panel having a top surface opposite a bottom surface, the first panel disposed on a first plane and is angled with respect to the floor of the oil pan, the first panel extends an entire length of the floor of the oil pan, a ramp contiguous to the first panel and disposed on a second plane angled with respect to the first plane, the first panel having a first peripheral edge opposite a second peripheral edge, a top wall extends outwardly from the second peripheral edge of the first panel, the second peripheral edge being lower than the first peripheral edge, wherein oil is pooled against the top wall slowing the flow of oil so as to allow the oil to aerate before reaching the intake pipe.

2. The oil pan assembly as set forth in claim 1, further including a bottom wall, the bottom wall disposed on the bottom surface of the first panel, the bottom wall having a first portion angled with respect to a second portion so as to form a catch for disrupting the flow of oil.

3. The oil pan assembly as set forth in claim 2, wherein the top wall is on one side of the first panel and the bottom wall is on the other side of the first panel.

4. The oil pan assembly as set forth in claim 2, wherein the inner plate includes at least one through hole, the at least one through hole adjacent to the top wall.

5. The oil pan assembly as set forth in claim 2, wherein the bottom wall is spaced apart from the first peripheral edge of the first panel.

6. The oil pan assembly as set forth in claim 3, wherein the first plane of the first panel is angled and wherein the top wall is elevated relative to the bottom wall.

7. The oil pan assembly as set forth in claim 3, wherein the bottom wall and the top wall are generally orthogonal to the first panel.

8. An engine assembly having an engine block, wherein the engine block is tilted, an oil pan assembly mounted to a bottom of the engine block, the oil pan assembly having an oil pan, an intake pipe and a pump, the oil pan having a floor, the floor disposed along a generally horizontal plane, the oil pan assembly configured to catch oil, direct the oil to the pump wherein the pump returns the oil to the engine block, the engine assembly comprising:

an inner plate mounted to the oil pan and disposed between the oil pan and the engine block, the inner plate having a first panel, the first panel having a top surface opposite a bottom surface, the first panel disposed on a first plane, the first panel extends an entire length of the floor of the oil pan, the first plane angled with respect to the floor of the oil pan, the first panel having a first peripheral edge opposite a second peripheral edge, a ramp contiguous to a first surface and disposed on a second plane angled with respect to the first plane so as to direct oil to the intake pipe, a top wall extends outwardly from the second a peripheral edge of the first panel, the second peripheral edge being lower than the first peripheral edge, wherein oil is pooled against the top wall slowing the flow of oil from the peripheral edge of the first panel so as to allow the oil to aerate before reaching the intake pipe.

9. The engine assembly as set forth in claim 8, further including a bottom wall, the bottom wall disposed on the bottom surface of the first panel, the bottom wall having a first portion angled with respect to a second portion so as to form a catch for disrupting the flow of oil.

10. The engine assembly as set forth in claim 9, wherein the top wall is on one side of the first panel and the bottom wall is on the other side of the first panel.

11. The engine assembly as set forth in claim 9, wherein the inner plate includes at least one through hole, the at least one through hole adjacent to the top wall.

12. The engine assembly as set forth in claim 9, wherein the bottom wall is spaced apart from the peripheral edge of the first panel.

13. The engine assembly as set forth in claim 10, wherein the first plane of the first panel is angled and wherein the top wall is elevated relative to the bottom wall.

14. The engine assembly as set forth in claim 10, wherein the bottom wall and the top wall are generally orthogonal to the first panel.

* * * * *